US009073662B2

(12) United States Patent
Flaming et al.

(10) Patent No.: US 9,073,662 B2
(45) Date of Patent: Jul. 7, 2015

(54) CONTAINERS WITH REINFORCED BOTTOM PANEL AND METHODS OF MAKING AND USING THE SAME

(75) Inventors: Max Flaming, Fresno, CA (US); Aaron Coon, Sanger, CA (US)

(73) Assignee: Maxco Supply, Inc., Parlier, CA (US)

( * ) Notice: Subject to any disclaimer, the term of this patent is extended or adjusted under 35 U.S.C. 154(b) by 882 days.

(21) Appl. No.: 13/275,137

(22) Filed: Oct. 17, 2011

(65) Prior Publication Data

US 2012/0090270 A1 Apr. 19, 2012

Related U.S. Application Data

(60) Provisional application No. 61/393,691, filed on Oct. 15, 2010, provisional application No. 61/394,729, filed on Oct. 19, 2010.

(51) Int. Cl.

| | |
|---|---|
| ***B65D 5/30*** | (2006.01) |
| ***B65D 5/4805*** | (2006.01) |
| ***B65D 5/44*** | (2006.01) |
| ***B65D 5/48*** | (2006.01) |
| ***B65D 5/32*** | (2006.01) |

(52) U.S. Cl.

CPC ..... *B65D 5/443* (2013.01); *B65D 5/48002* (2013.01); *B65D 5/30* (2013.01); *B65D 5/48022* (2013.01); *B65D 5/323* (2013.01)

(58) Field of Classification Search

CPC .. B65D 5/30; B65D 5/48002; B65D 5/48022; B65D 5/443

USPC ..... 53/456; 229/120.17, 120.33; 493/90, 493/162, 912

See application file for complete search history.

(56) References Cited

U.S. PATENT DOCUMENTS

| | | | |
|---|---|---|---|
| 1,330,780 | A | 2/1920 | Bonte |
| 1,584,972 | A | 5/1926 | Bliss |
| 1,636,071 | A | 7/1927 | Pitt |
| 1,940,010 | A | 12/1933 | Murray |

(Continued)

FOREIGN PATENT DOCUMENTS

| | | | | |
|---|---|---|---|---|
| EP | 0571696 | | 12/1993 | |
| EP | 2028115 | A1 * | 2/2009 | ..... B65D 5/48022 |
| JP | 04290735 | A * | 10/1992 | ..... 493/90 |

OTHER PUBLICATIONS

International Search Report and Written Opinion; International Application No. PCT/US2011/056591; Dated Mar. 22, 2012; 12 pages; International Searching Authority / United States, Commissioner for Patents, Alexandria, Virginia.

(Continued)

*Primary Examiner* — Stephen F Gerrity

(74) *Attorney, Agent, or Firm* — Andrew D. Fortney; Central California IP Group, P.C.

(57) ABSTRACT

Containers with reinforced bottom panels, methods of making containers with reinforced bottom panels, and methods of using containers with reinforced bottom panels. The containers with reinforced bottom panels have one or more bottom panels, one or more pleats folded along a center line at an angle of about 180°, two side panels, two end panels, and two pairs of side panel extensions. The pleats provide extra strength to the bottom panels of the containers, thereby reducing or eliminating sag in the bottom panels of such containers, particularly when high-water content goods are placed in such containers or when such containers are stored or used in a high-humidity environment.

20 Claims, 12 Drawing Sheets

(56) References Cited

U.S. PATENT DOCUMENTS

| | | | | | |
|---|---|---|---|---|---|
| 2,007,697 | A | | 7/1935 | Usher | |
| 2,112,433 | A | * | 3/1938 | Boeye | 229/117.17 |
| 2,217,028 | A | * | 10/1940 | Powell | 206/169 |
| 2,308,177 | A | | 1/1943 | Jones | |
| 2,689,077 | A | | 9/1954 | Main | |
| 2,718,997 | A | * | 9/1955 | Shuxteau | 229/117.13 |
| RE26,386 | E | * | 5/1968 | Crane | 206/509 |
| 3,934,790 | A | | 1/1976 | Easter | |
| 3,935,990 | A | | 2/1976 | Crane | |
| 3,937,390 | A | | 2/1976 | Winkler | |
| 3,993,239 | A | | 11/1976 | Exel | |
| 4,335,843 | A | | 6/1982 | Kent | |
| 4,371,366 | A | * | 2/1983 | Bower et al. | 493/138 |
| 4,607,750 | A | | 8/1986 | Valenti | |
| 4,645,122 | A | | 2/1987 | Nederveld | |
| 4,848,648 | A | * | 7/1989 | Eisman | 229/120.17 |
| 4,884,739 | A | | 12/1989 | Nederveld | |
| 4,944,451 | A | * | 7/1990 | Forbes, Jr. | 229/120.17 |
| 5,009,363 | A | * | 4/1991 | Zavatone | 229/120.17 |
| 5,056,709 | A | * | 10/1991 | Cargile, Jr. | 229/120.17 |
| 5,326,017 | A | * | 7/1994 | Liu et al. | 229/120.17 |
| 5,690,272 | A | | 11/1997 | England | |
| 6,471,121 | B1 | * | 10/2002 | Nielsen | 229/120.17 |
| 2004/0056081 | A1 | | 3/2004 | Christensen et al. | |
| 2006/0169756 | A1 | | 8/2006 | Sexton et al. | |

OTHER PUBLICATIONS

"Corrugated Box Styles"; Imperial Paper Company, 2009; 5 pages; http://www.imperialpaper.com/measure_corrugated.html (last visited Sep. 23, 2010).

Melissa Montague; "Corrugated Packaging 101"; wexxar/BEL; 5 pages; Wexxar Packaging Inc.

* cited by examiner

CONTAINERS WITH REINFORCED BOTTOM PANEL AND METHODS OF MAKING AND USING THE SAME

RELATED APPLICATIONS

This application claims the benefit of U.S. Provisional Patent Application Nos. 61/393,691, filed Oct. 15, 2010 and 61/394,729, filed Oct. 19, 2010, both of which are incorporated herein by reference in their entirety.

FIELD OF THE INVENTION

The present invention generally relates to the field of containers and methods of making and using the same. More specifically, embodiments of the present invention pertain to containers with reinforced bottom panels having pleats, folds or ribs that add strength to the bottom panels of the containers, thereby reducing or eliminating bottom sag. Embodiments of the present invention also relate to methods of making and using such containers with reinforced bottom panels.

DISCUSSION OF THE BACKGROUND

Certain containers, such as boxes made from corrugated paper, cardboard and/or similar materials, can be affected by "bottom sag." Bottom sag occurs when the weight of the product inside the container causes the bottom panel of the box to take on a convex, bowed-out shape, rather than staying flat or straight. This happens to some degree in all Bliss-type containers or other types of containers made from cardboard, corrugated paper, paperboard (and to a lesser degree in containers made from laminates), but is especially pronounced when the containers containing the product are stored for some period of time in a high humidity environment (e.g., a refrigerated room or other cooled storage environment). Bottom sag can cause the contents of containers to shift, potentially damaging the contents and/or making the subsequent stacking of containers more difficult and/or unstable. In extreme cases, the bottoms of such containers may break, tear or rupture, allowing the contents of the containers to fall out, potentially damaging the product that was contained therein. Such contents may also require repackaging into another container, creating additional material and labor expenses.

Therefore, the need exists for containers with reinforced bottom panels that reduce or prevent bottom sag, so that the products packed in the containers are not damaged and/or do not have to be repacked. Likewise, there is a need for methods of efficiently making and using such containers with reinforced bottom panels.

This "Background" section is provided for background information only. The statements in this "Background" are not an admission that the subject matter disclosed in this "Background" section constitutes prior art to the present disclosure, and no part of this "Background" section may be used as an admission that any part of this application, including this "Background" section, constitutes prior art to the present disclosure.

SUMMARY OF THE INVENTION

The present invention relates to containers or boxes having one or more pleats, folds or ribs in the bottom panels. The pleats, folds or ribs (hereinafter, "pleats," or individually, "pleat") provide extra strength to the bottom panels of the containers or boxes, thereby reducing or eliminating bottom sag. A container (e.g., a Bliss-type box or tray) is provided having one or more bottom panels, one or more pleats (see, e.g., 140 and 140*a-e* in FIGS. 1A-1D) attached to the bottom panel(s), configured to provide additional strength to the bottom panel(s), two side panels foldably attached to the bottom panel(s), two end panels, and two pairs of side panel extensions, each pair of side panel extensions foldably attached to one of the two side panels and to the end panels.

In some embodiments (see, e.g., the embodiments shown in FIGS. 1A and 1D), each of the end panels has a slit, and the ends of the pleat(s) are inserted into or captured by the slit(s). The slits in the end panels prevent the pleat from unfolding (especially in the absence of adhesive applied between folds of the pleat). In alternative embodiments (see, e.g., the embodiments shown in FIGS. 1B and 1C), the ends of the pleats 140, 140*a-b* are adjacent to and/or in contact with the end panels of the containers. In some embodiments, glue or other adhesive may be added between the folds of the pleats 140, 140*a-b* to help hold the pleats together and/or provide additional strength to the bottom panels of the containers.

The present invention further provides methods of making and using containers with reinforced bottom panels (e.g., containers 100A-100D as shown in FIGS. 1A-1D). The method of making the container generally includes (i) folding each of two side panels to form an angle of from about 85° to about 100° with respect to one of at least two bottom panel portions of a container blank, (ii) folding each of one or more bottom pleat portions at an angle of about 180° about a center line to form a pleat by pushing in a first direction on the pleat portion(s) and/or pushing opposed edges of each bottom pleat portion in a second direction, (iii) folding or placing two end panels relative to the bottom panels, (iv) folding each side panel extension of two pairs of side panel extensions at an angle of about 90° with respect to the side panel to which the side panel extension is attached, and (v) attaching each of the side panel extensions to one of two end panels. In some embodiments, the method further includes applying glue and/or other adhesive to a side or a back side of at least one bottom pleat portion, prior to folding the bottom pleat portion to form a pleat. The pleat provides extra strength to the bottom panel, thereby reducing or eliminating bottom sag in the container.

These and other advantages of the present invention will become readily apparent from the detailed description of various embodiments below.

DETAILED DESCRIPTION

Figure 1A:
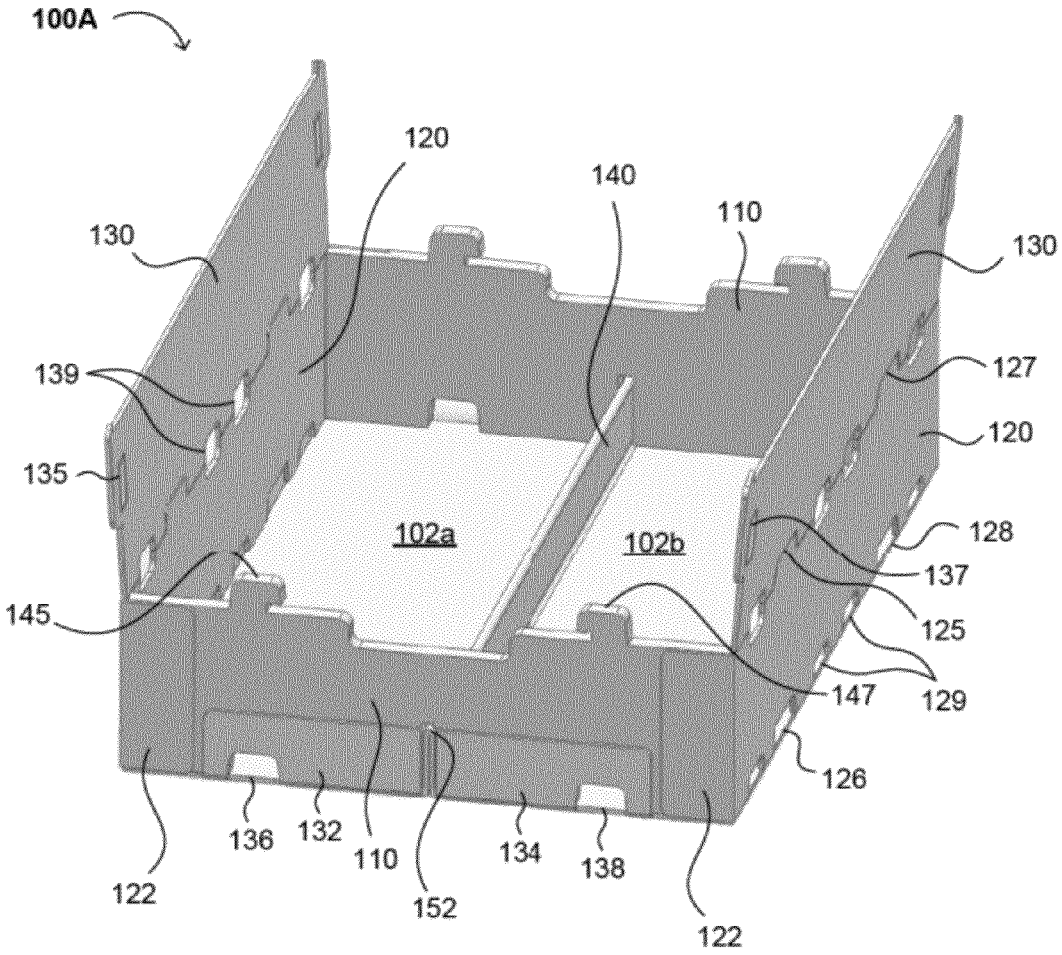
FIG. 1A is a perspective view of an exemplary Bliss-type container with a pleat in the bottom panel and slits in the end panels to capture the ends of the pleat.

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "container," "box" and "tray" are generally used interchangeably herein and use of one generally includes the others, unless the context necessarily indicates otherwise, but these terms are generally given their art-recognized meanings. The terms "cutout" and "hole" are also generally used interchangeably herein, but are generally given their art-recognized meanings.

Exemplary Containers with Reinforced Bottom Panel

Referring to the drawings wherein like reference numbers correspond to like or similar parts throughout the several views, and referring particularly to the exemplary embodiments of FIGS. 1A-1D, embodiments of the present invention relate to containers or boxes having one or more pleats 140 and 140*a-e* attached to the bottom panels 102*a-g*, which provide extra strength to the bottom panels of the containers or boxes, thereby reducing or eliminating bottom sag.

Figure 1B:
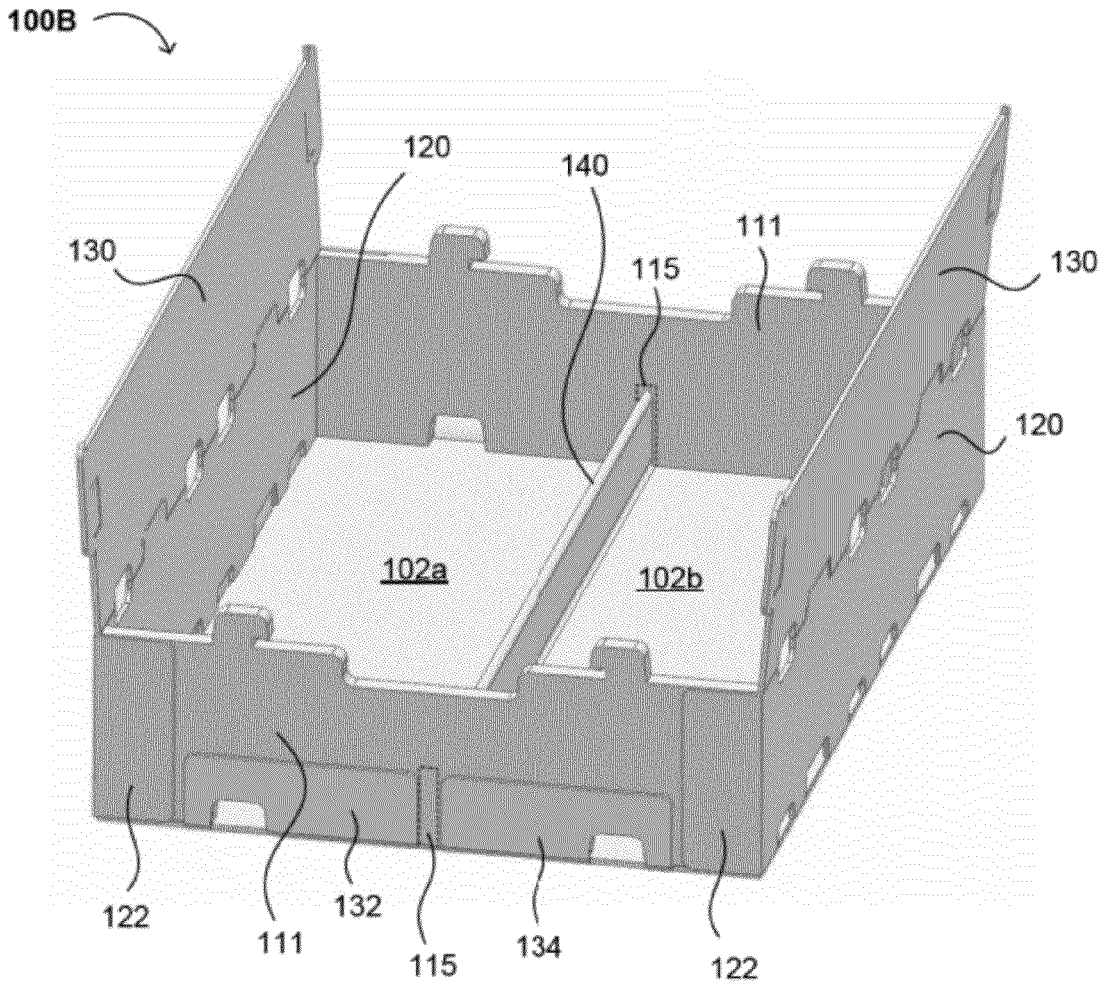
FIG. 1B is a perspective view of an exemplary tray-type container with a pleat in the bottom panel, where the end panels have flat surface portions that cover the ends of the pleat.

In some embodiments, containers 100A-100D are made from corrugated paper. In other embodiments, containers 100A-100D may be made from cardboard, paperboard, a laminate (e.g., paperboard or corrugated paper laminated with plastic and/or foil), combinations thereof, etc. While the embodiments shown in FIGS. 1A, 1B and 1D are Bliss-type trays, the invention is not limited to Bliss-type containers, and may be applicable to any container (e.g., including, but not limited to, boxes such as regular slotted cases [RSCs] and other cases, center special-slotted containers, bins, trays such as one-piece trays with lid flaps or top flaps, and other containers). In various embodiments, the container may be or include any container that requires or benefits from added strength or support in the bottom panel, and in which a pleat may be formed or attached.

FIG. 1A shows a first embodiment of the present invention comprising a Bliss-type container 100A, having end panels 110, side panels 120, side panel extensions 122, lid flaps 130, bottom panel portions 102*a*, 102*b* and a pleat 140 foldably attached to bottom panels 102*a*, 102*b* and further folded about 180° along its center line. In the embodiment shown in FIG. 1A, the pleat 140 is approximately centered in container 100A (i.e., the pleat 140 is located at a point about halfway along the width of the container 100A). Consequently, the two bottom panel portions 102*a* and 102*b* are about equal in size. In other embodiments, the pleat 140 may be located anywhere along the width of container 100A (e.g., at a point from about 5% to 95% along the width of the container 100A). In embodiments where a single pleat 140 is not centered along the width of the container 100A, the bottom panel portions may be unequal in size. However, as a practical matter, the pleat(s) 140 will be located away from a side panel 120 and/or spaced apart from one another by about $1/n^{th}$ (from about $1/10^{th}$ to about ½ [e.g., at $1/8^{th}$, $1/6^{th}$, $1/5^{th}$, $1/4^{th}$, $1/3^{rd}$ or ½]) of the width of container 100A, where n equals the number of bottom panels.

In FIG. 1A, end panels 110 each have a slit 152 configured to capture one end of the pleat 140. When the bottom panel is made from corrugated material, the flutes in the corrugated material may be aligned with the slits in the end panels. Generally, the height and width of the slit 152 may be just slightly greater than the height and the width of the pleat 140 so that the slit 152 captures the pleat 140 and prevents the pleat 140 from unfolding. In FIG. 1A, pleat 140 is shown to be approximately half of the height of the end panels 110. However, the height of pleat 140 may be as little as 10% or as much as 90% (e.g., 15%, 33%, 65%, etc.) of the height of the end panels 110 and/or side panels 120. Consequently, the height of slit 152 may be slightly greater than 10% or just slightly greater than 90% of the height of end panels 110, or it may be anywhere in between, as long as the height of the slit 152 is greater than the height of the pleat (e.g., 16% when the pleat is 15% of the height of end panel 110, 35% when the pleat is 33% of the height of end panel 110, etc.).

In some embodiments, container 100A may include one or more cutouts/holes 129, 139 in the side panels 120 and/or lid flaps 130, configured to provide opening(s) (e.g., for airflow) in the container 100A. Similarly, end panels 110 and end flaps 132, 134 may include one or more end cutouts/holes 136, 138. In some embodiments, one or more index cutouts 126, 128 in side panels 120, may mate with and/or align with indexing tabs 125, 127 respectively, at the top of side panels 120, when the container 100A is stacked on top of another container 100A. Further, end panels 110 may comprise one or more flap securing tabs 145, 147, configured to mate with cutouts 135, 137 in lid flaps 130, to secure the lid flaps 130 to the end panels 110 when the lid flaps are folded at an angle of about 90° with respect to the side panels 120 to close the top of container 100A.

Figure 1C:
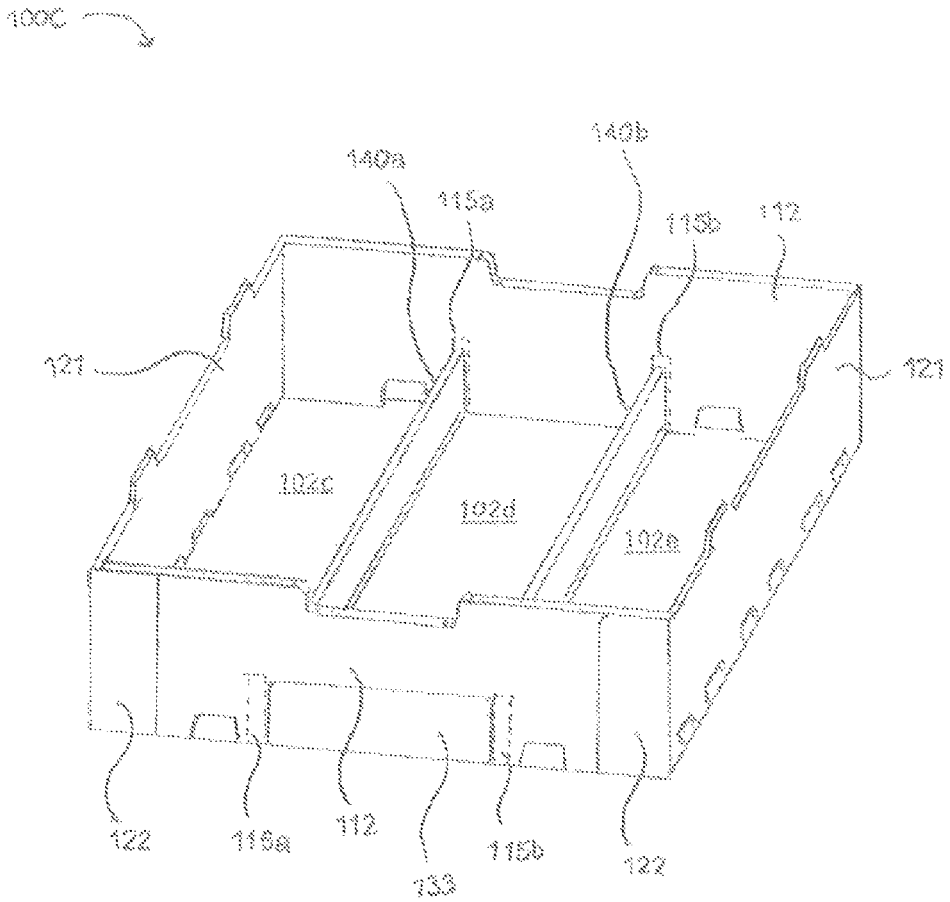
FIG. 1C is a perspective view of an exemplary tray-type container with two spaced-apart pleats in the bottom panel.
Figure 1D:
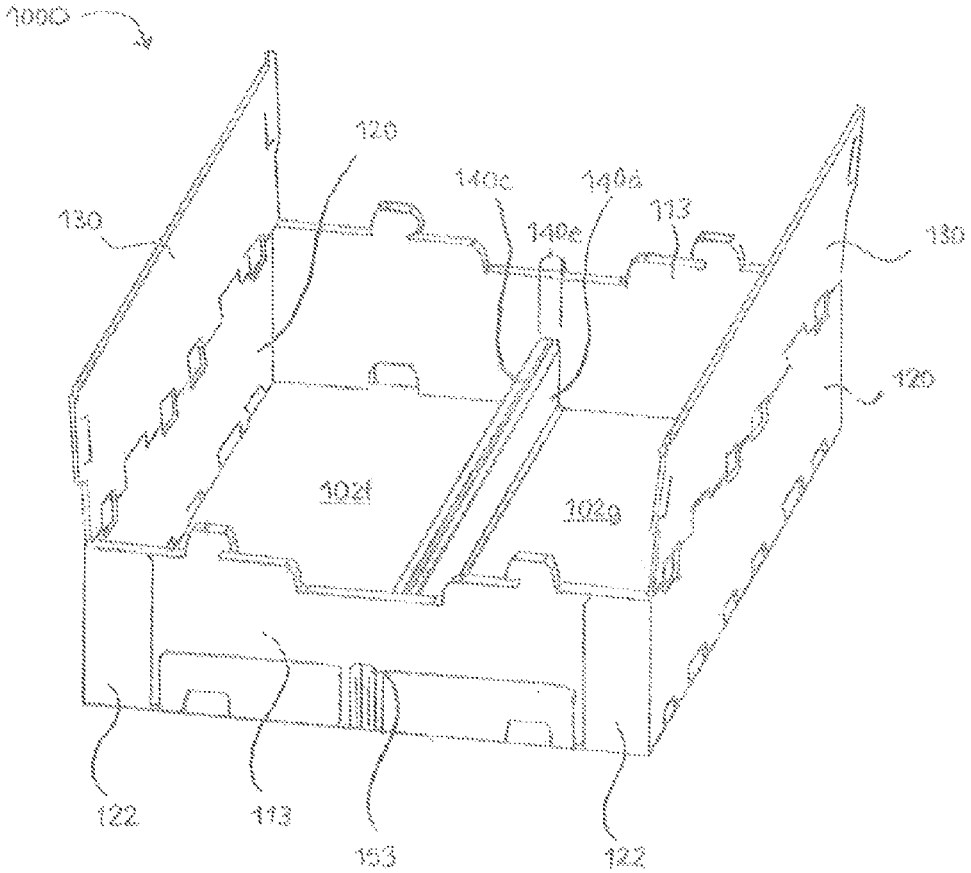
FIG. 1D is a perspective view of an exemplary Bliss-type container with two back-to-back pleats in the bottom panel that are captured by a single slit or cutout in each of the end panels.

Referring now to FIGS. 1B-1C, embodiments of the present invention comprise containers 100B, 100C having one or more pleats 140, 140*a*, 140*b*, but where each of the end panels 111, 112 does not contain a slit, and instead, has a flat surface portion 115, 115*a*, 115*b* configured to cover one end of each pleat 140, 140*a*, 140*b*. In some embodiments where the end panels 111, 112 comprise the flat surface portion(s) 115, 115*a*, 115*b*, the end of each pleat 140, 140*a*, 140*b* that is adjacent to the flat surface portion 115, 115*a*, 115*b* may or may not contact the adjacent end panel 111, 112, and there can be a gap between each end of the pleat 140, 140*a*, 140*b* and the adjacent end panel. In other embodiments, the end of each pleat 140, 140*a*, 140*b* may contact and/or be attached (e.g., with glue or another adhesive) to the adjacent end panel 111, 112.

As shown in FIG. 1C, two pleats 140*a*, 140*b* may be spaced a distance apart across the width of container 100C. In some embodiments, each of the two pleats 140*a*, 140*b* may be the same distance from the nearest side panel 121 and from each other, and consequently, bottom panel portions 102*c*, 102*d* and 102*e* may be of equal size. However, the two pleats 140*a*, 140*b* may be located anywhere along the along the width of container 100C, and the bottom panel portions 102*c*, 102*d* and 102*e* may be unequal sizes. In some embodiments, 102*c* may be about the same size as 102*e*. Further, the invention is not limited to having only two pleats, and the container may contain any integer number (e.g., 3, 4, 5, 6, 7, 8 or more) of pleats. Further, as shown in FIG. 1C, container 100C may comprise a single end flap 133 per end panel, attached to each end panel 112. However, the present invention is not limited to a single end flap 133, and alternative embodiments may include two or more end flaps (see e.g., FIGS. 1A, 1B and 1D), or no end flaps at all (see, e.g., FIG. 5B).

As shown in FIG. 1D, two pleats 140*c*, 140*d* are located back-to-back to form a stacked pleat or "multi-pleat" 140*e*. In FIG. 1D, each of the end panels 113 has a single slit or cutout 153, configured to capture one end of multi-pleat 140*e*. However, multi-pleat 140*e* may comprise more than two (e.g., 3, 4 or more) pleats configured back-to-back, and the width of slit or cutout 153 may be adjusted accordingly to accommodate the number of individual pleats. For example, in the embodiment of FIG. 1D, the width of slits/cutouts 153 may be slightly greater than the width of multi-pleat 140*e* (which is approximately equal to the widths of the back-to-back pleats 140*c*, 140*d* added together; i.e., the width of pleat 140*c* plus the width of pleat 140*d*). For three individual pleats configured back-to-back, the width of slit or cutout 153 would be approximately equal to the width of the three individual pleats added together, etc. In some embodiments, the height of the individual pleats 140*c*, 140*d* may be the same. In other embodiments, the height of each individual pleat may vary from pleat to pleat, and the height of the slit/cutout 153 may be adjusted accordingly.

Typically, the pleats 140, 140*a-e* run the entire length of the container, as shown in FIGS. 1A-1D. However, in some embodiments, one or more pleats may not extend the entire length of the container, most typically when two or more pleats are located back-to-back (e.g., as shown in FIG. 1D). In some embodiments, glue and/or another adhesive may be applied to the back side of the pleats 140, 140*a-e* before the pleats 140, 140*a-e* are folded, to help prevent the pleats 140, 140*a-e* from unfolding. The glue and/or other adhesive may be in lieu of or in addition to having slits (e.g., 152 in FIG. 1A or 153 in FIG. 1D) in the end panels to capture the pleats. Further, glue and/or other adhesive may be used to hold back-to-back pleats against each other (in lieu of or in addition to having slits in the end panels to capture the pleats or otherwise hold the pleats together). In such embodiments, the glue and/or adhesive is applied to the top surface of the container blank. In some embodiments, a secondary stiffener (not shown) may be added between the folds of a pleat. In embodiments with slits in the end panels to capture the pleats, the stiffener may be added after the pleat is folded, but before the pleat is captured by the slits. In other embodiments, the stiffener may be added before the pleat is folded, and glue and/or other adhesive may be applied to the stiffener and/or the pleat, to hold the stiffener against the back side of the pleat during the folding process.

Exemplary Containers with Attached Pleats

Figure 2:
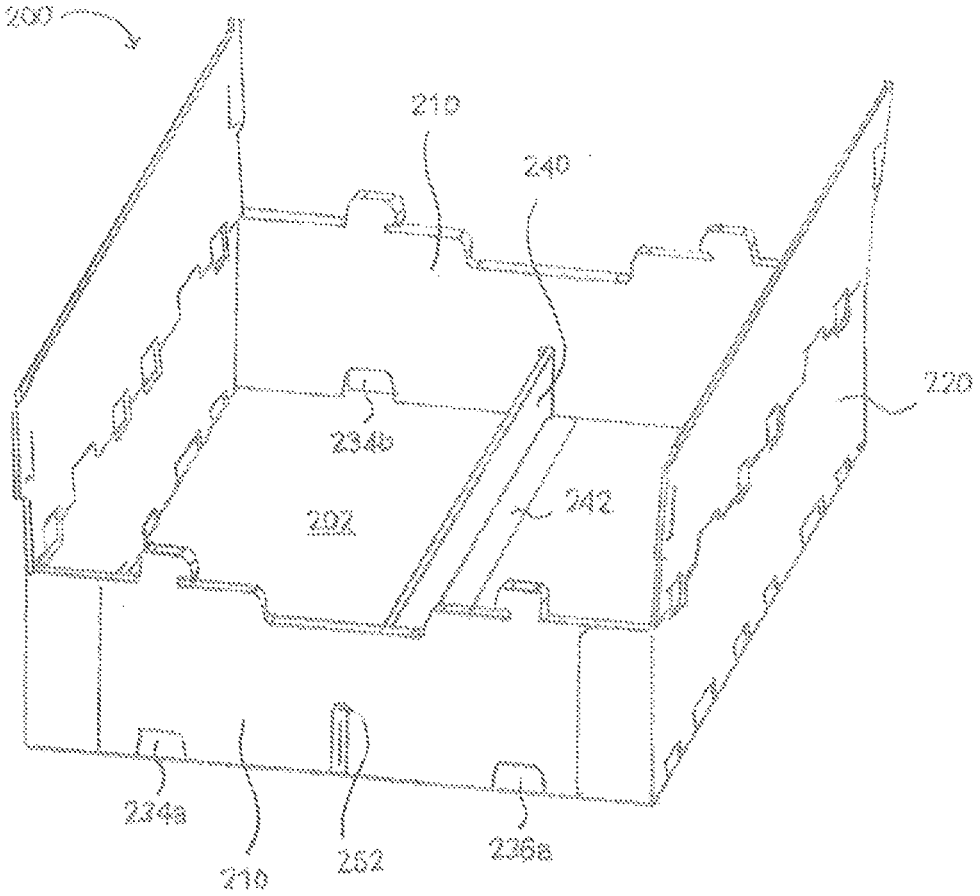
FIG. 2 is a perspective view of an exemplary Bliss-type container that includes a pleat attached to the bottom panel of the container using pleat extensions.

Referring now to FIG. 2, an embodiment of the present invention is shown in which a container 200 comprises a pleat 240 and a pleat extension 242 affixed to the bottom panel 202 of the container 200. In the embodiment shown in FIG. 2, the pleat 240 and pleat extension 242 are formed from a pleat blank (see, e.g., 300A in FIG. 3A or 300B in FIG. 3B) separate from the container blank (i.e., for the bottom panel 202 and side panels 220). The folded pleat blank is then attached to the bottom panel 202 with glue and/or another adhesive before, during or after assembly of the container 200. Generally, in the embodiment of FIG. 2, pleat 240 is attached before folding or attaching end panels 210.

The length of the pleat extension 242 may be the same as the length of pleat 240, as shown in FIG. 2 (see also 342*a*, 342*b* in FIG. 3A), or the length of the pleat extension 242 may be less than the length of the pleat 240. Thus, the pleat extension 242 may extend only part of the way across the length of container 200. Typically, the length of the pleat 240 may be greater than the length of the pleat extension 242 by from about 1% to 200%. In one example, pleat 240 has a length that is greater than that of pleat extension 242 by about 1 to 2 times the thickness of the end panel 210 at each end of the pleat 240. The additional length of the pleat 240 facilitates insertion of the pleat 240 into slits 252 in end panels 210.

Figure 3A:
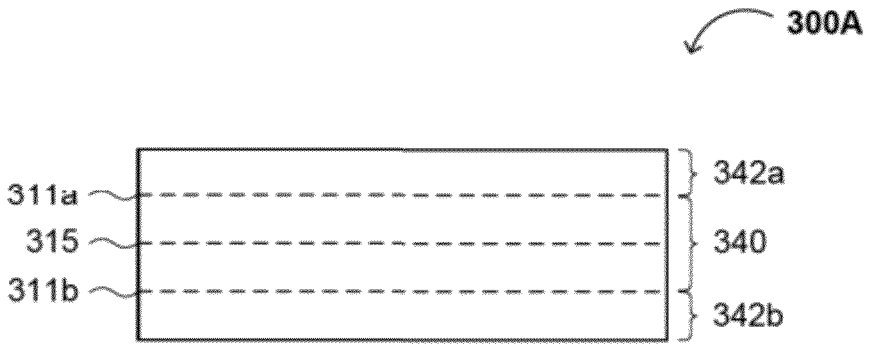
FIG. 3A shows a first exemplary pleat blank with a pleat extension on each side of the bottom pleat portion.

In some embodiments, two pleat extensions 242, one on each side of the pleat 240, may be used to secure the pleat 240 to the bottom panel 202 and/or stabilize the orientation (e.g., at an angle of about 90°) of the pleat 240 with respect to the bottom panel 202 (see, e.g., pleat extensions 342*a* and 342*b* on each side of bottom pleat portion 340 in FIG. 3A). Additionally, multiple pleat extensions on one or both sides of the pleat 240 may be used to secure pleat 240 to the container bottom 202 (see, e.g., pleat extensions 382*a*, 382*b*, 383*a*, 383*b*, 384*a* and 384*b* in FIG. 300B). For multiple pleats 240 in close proximity to each other across the width of container 200, a pleat extension 242 for one pleat 240 may abut or overlap a pleat extension 242 of an adjacent pleat 240. Further, the width of each pleat extension may vary from as little as about 20% to as much as 100% or more (e.g., 25%, 40%, 75%, 105%, etc.) of the height of pleat 240. Typically, the greater the height of the pleat 240, the smaller the relative width of each pleat extension 242 will be as a percentage of the height of the pleat. Likewise, the smaller the height of the pleat 240, the greater the relative width of each pleat extension 242 will be as a percentage of height of the pleat.

In the example of FIG. 2, the end panels 210 are foldably attached to the bottom panel 202 along the entire edge between the end panel 210 and the bottom panel 202, except for slit 252 and any cutouts (e.g., 234*a*, 234*b* and 236) at the edge. While the additional strength provided by pleat 240 to reduce or eliminate bottom sag may be less than the additional strength provided by the pleats 140, 140*a-e* in the exemplary containers of FIG. 1A-1D (in which the pleats 140, 140*a-e* are foldably attached to one or more of bottom panel portions 102*a-g*), at least some (and in some cases a surprising proportion of) additional strength is provided to the bottom panel 202 by pleat 240. Additionally, the manufacturing process for the container 200 is simpler and less expensive than the manufacturing process for the containers 100A-100D of FIGS. 1A-1D. Further, because they are foldably attached (except at slits 252, and cutouts 234*a*, 234*b* and 236*a*) to the bottom panel 202, the end panels 210 of FIG. 2 may provide greater stacking strength to the container 200 than end panels 550*a*, 550*b* of FIG. 5A and end panels 570*a*, 570*b* of FIG. 5B, only a portion of which are foldably attached to bottom panel portions 502*a* and 502*b*. When made using corrugated material, the stacking strength of end panels 210 may also depend on the orientation of the flutes in the corrugated material.

Exemplary Blanks for Separately Attached Pleats

Figure 3B:
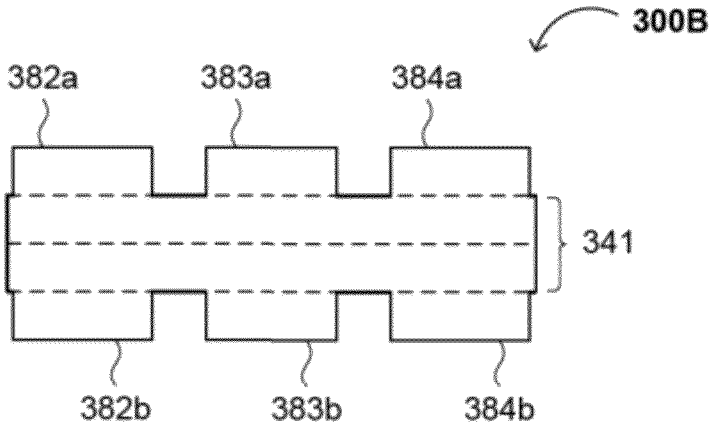
FIG. 3B shows a second exemplary pleat blank with multiple pleat extensions on both sides of the bottom pleat portion.

FIGS. 3A and 3B show exemplary pleat blanks, 300A, 300B, each of which may be folded and attached to the bottom of a formed or partially formed container (see, e.g., FIG. 2). In the embodiment shown in FIG. 3A, bottom pleat portion 340 is foldably attached to pleat extensions 342*a* and 342*b* on each side of bottom pleat portion 340. However, in alternative embodiments, there may be a pleat extension on only one side of bottom pleat portion 340. In some embodiments, pleat extensions 342*a* and 342*b* may not extend the entire length of the bottom pleat portion 340 (i.e., opposing ends of bottom pleat portion 340 extend beyond the opposing ends of pleat extensions 342*a* and 342*b*; see, e.g., 382*a*, 382*b*, 384*a*, 384*b* in FIG. 3B). Additionally, in some embodiments, bottom pleat portion 340 may include an optional score 315 along an approximate center line and/or optional scores 311*a*, 311*b* between bottom pleat portion 340 and pleat extensions 342*a*, 342*b*. In some embodiments, scores 311*a*, 311*b* and 315 may be on one side of the pleat blank 300A. In other embodiments, scores 311*a*, 311*b* may be located on one side (i.e., a top side facing the reader) of pleat blank 300A, and score 315 may be located on the opposite side of pleat blank 300A. In yet other embodiments, the blank 300A is not scored.

In the embodiment shown in FIG. 3B, pleat blank 300B includes multiple pleat extensions 382*a*/382*b*, 383*a*/383*b*, 384*a*/384*b* on both sides of bottom pleat portion 341. Although the embodiment in FIG. 3B shows three pleat extensions on each side of the bottom pleat portion 341, the number of pleat extensions on one side of bottom pleat portion 341 may be 0 or may be any integer number between 0 and about 10 (e.g., 1, 2, 3, 4, etc.). Further, the number of pleat extensions on one side of bottom pleat portion 341 may be different than the number of pleat extensions on the other side of bottom pleat portion 341. However, as a practical matter, the number of pleat extensions on each side of the bottom pleat portion 341 will typically be the same, and will generally be 6 or less. To maximize the efficient use of pleat blank material, pleat extensions and the spaces between pleat extensions may alternate, from one side of the pleat blank to the other or from pleat blank to pleat blank.

Figure 3C:
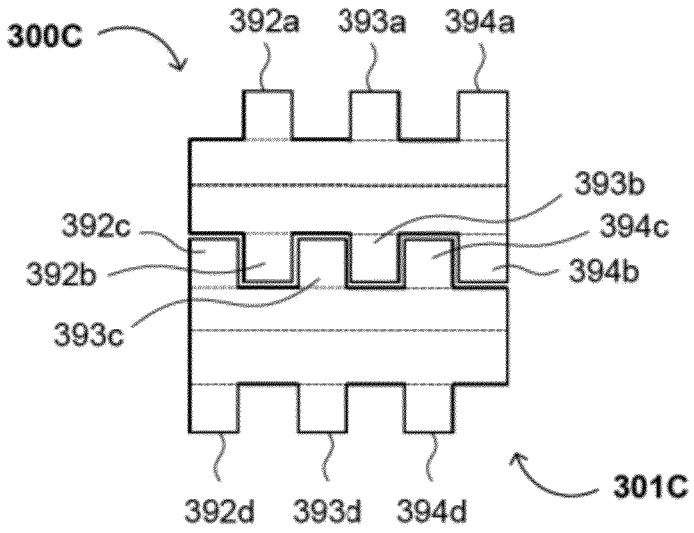
FIG. 3C shows two different pleat blanks arranged for efficient use of pleat material, where pleat extensions and the spaces between pleat extensions alternate from pleat blank to pleat blank.
Figure 3D:
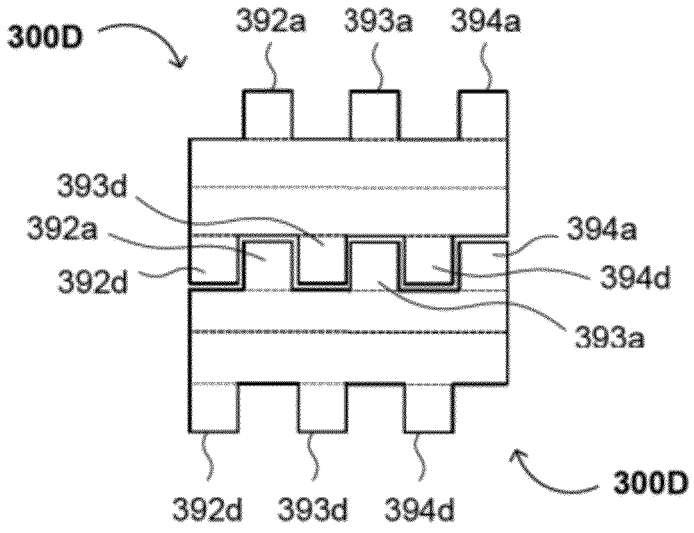
FIG. 3D shows two identical pleat blanks arranged for efficient use of pleat material, where pleat extensions and the spaces between pleat extensions alternate from one side of the pleat blank to the other side of the pleat blank.

FIGS. 3C and 3D show exemplary pleat blanks for forming pleats with multiple pleat extensions, arranged to make efficient use of pleat blank material. In the embodiment shown in FIG. 3C, pleat extensions 392*a*/392*b*, 393*a*/393*b*, 394*a*/394*b* and the spaces between pleat extensions 392*a*/392*b*, 393*a*/393*b*, 394*a*/394*b* of pleat blank 300C are configured to alternate with pleat extensions 392*c*/392*d*, 393*c*/393*d*, 394*c*/394*d* and the spaces between pleat extensions 392*c*/392*d*, 393*c*/393*d*, 394*c*/394*d* of pleat blank 301C, such that pleat extensions 392*a*/392*b*, 393*a*/393*b*, 394*a*/394*b* of pleat blank 300C mate with and/or otherwise fit in the spaces between pleat extensions 392*c*/392*d*, 393*c*/393*d*, 394*c*/394*d* of pleat blank 301C. Thus, in the embodiment shown in FIG. 3C, pleat extensions and the spaces between pleat extensions alternate from pleat blank to pleat blank. Alternatively, in FIG. 3D, pleat extensions 392*a*/392*d*, 393*a*/393*d*, 394*a*/394*d* and the spaces between pleat extensions 392*a*/392*d*, 393*a*/393*d*, 394*a*/394*d* alternate from one side of pleat blank 300D to the other side of pleat blank 300D. Thus, in the embodiment shown in FIG. 3D, the same pleat blank 300D will mate and/or fit together with another pleat blank 300D to make efficient use of pleat blank material. Although the embodiments in FIGS. 3C and 3D show three pleat extensions on each side of pleat blanks 300C, 301C and 300D, the pleat blanks may have as few as a single pleat extension on one side or as many as 10 pleat extensions or more. Further, although two pleat blanks are shown in each of FIGS. 3C and 3D, any number of pleat blanks that fit on a single piece of pleat stock material may be similarly arranged.

Exemplary Container Blanks for Containers with Reinforced Bottom Panels

Figure 4A:
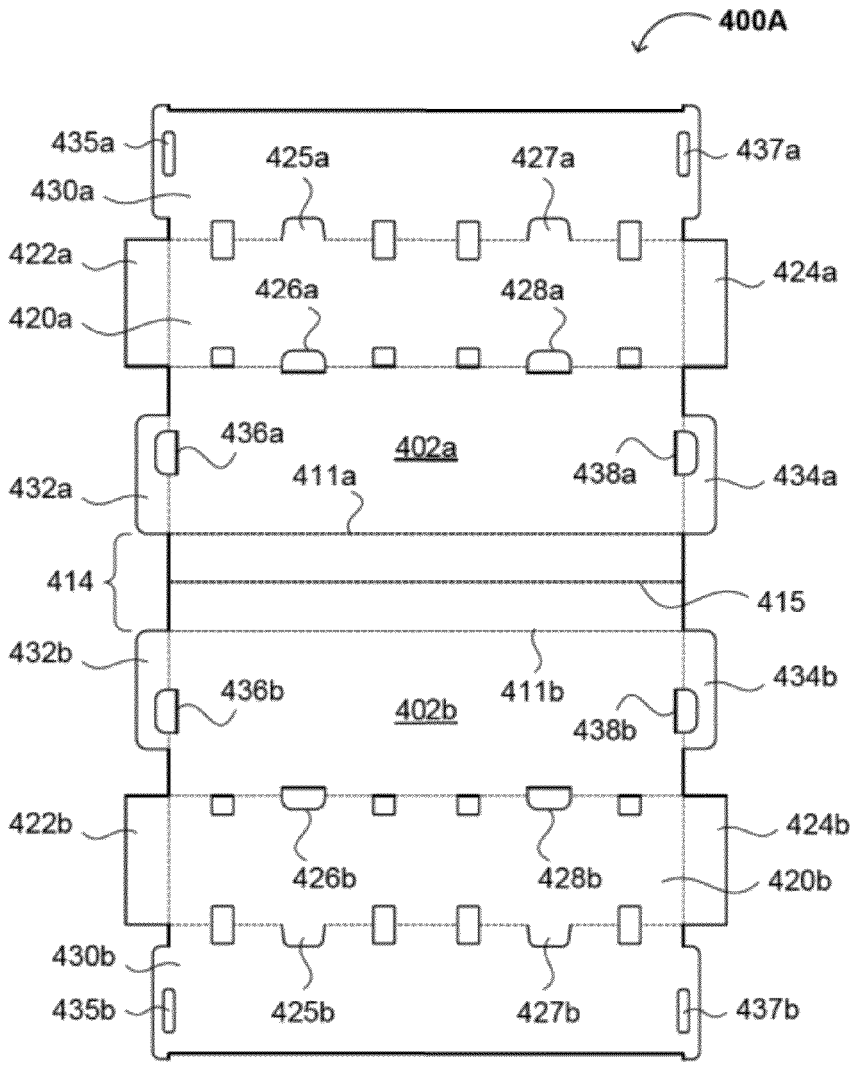
FIG. 4A shows an exemplary blank for the Bliss-type container of FIGS. 1A-1B with a pleat in the bottom panel, where the end panel blanks are separate from the container blank.

FIGS. 4A-4E show exemplary blanks for containers with reinforced bottom panels. In some embodiments, the blanks shown are made from corrugated paper. In other embodiments, the container blanks shown in FIGS. 4A-4E may be made from cardboard, paperboard, a laminate (e.g., paperboard or corrugated paper laminated with plastic and/or foil), combinations thereof, etc. While the embodiment shown in FIG. 4A, is for a Bliss-type tray (see, e.g., FIGS. 1A, 1B and 1D), the invention is not limited to Bliss-type containers, and may be applicable to any container (see, e.g., FIG. 1C). In various embodiments, the container may be or include any container that requires or benefits from added strength or support in the bottom panel. When the bottom panel is made from corrugated material, the flutes in the corrugated material may be aligned with the slits (if any) in the end panels.

FIG. 4A shows a blank 400A for a wrap of a Bliss-type container (such as container 100A and 100B in FIGS. 1A and 1B). The blank 400A is generally cut from a single sheet of board stock (e.g., corrugated paper or fiberboard, cardboard, etc. which may be single-ply, double-ply or triple-ply, laminated or coated with plastic, wax, adhesive paper, etc.). More than one blank 400A may be cut from a single sheet of board stock. Cuts or slits in the blank 400A are designated by a straight line, whereas scores (e.g., lines impressed into the material of the blank 400A for ease of folding the container into its predetermined shape) are designated by a dashed line.

Figure 4B:
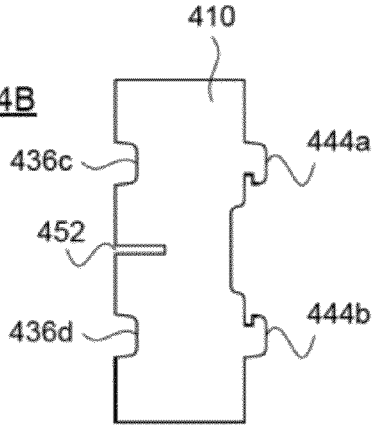
FIG. 4B shows a separate end panel blank with a slit to capture one end of the pleat, for the container of FIG. 1A.
Figure 4C:
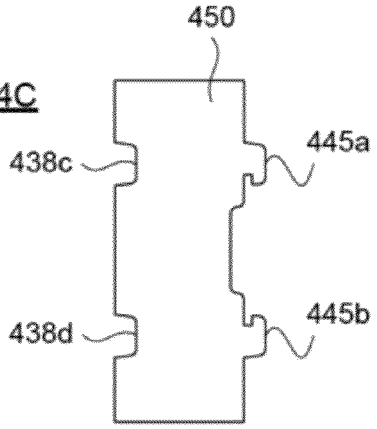
FIG. 4C shows a separate end panel blank with a flat surface portion, for the container of FIG. 1B.

Blank 400A includes two bottom panel portions 402*a*, 402*b*, side panels 420*a*, 420*b*, and top flaps 430*a*, 430*b*. Although the embodiment shown in FIG. 2A includes top flaps 430*a*, 430*b*, the invention is not limited to containers with top flaps (see, e.g., FIGS. 4D and 5B). Each of the side panels 420*a*, 420*b* has a pair of side panel extensions 422*a*/424*a* and 422*b*/424*b*, respectively, which secure each of the side panels 420*a*, 420*b* to two end panels (examples of which are shown in FIGS. 4B and 4C). Blank 400A also includes a bottom pleat portion 414, and four end flaps 432*a*, 432*b*, 434*a* and 434*b*. The bottom pleat portion 414 is foldably attached to bottom panel portions 402*a*, 402*b* at optional scores 411*a*, 411*b*. Bottom pleat portion 414 also includes an optional score 415 located approximately at a center line of bottom pleat portion 414. Although the embodiment shown in FIG. 2A includes scores 411*a*, 411*b* and 415 on one side of the blank 400A, in other embodiments, scores 411*a* and 411*b* are located on one side (e.g., a top side facing the reader) of blank 400A, and score 415 is located on the opposite side of blank 400*a*. In yet other embodiments, the blank 400A is not scored.

Each of the end flaps 432*a*, 432*b*, 434*a* and 434*b* (as well as small, adjacent parts of the bottom panel portions 402*a* and 420*b*) may have one or more optional cutouts 436*a*, 436*b*, 438*a*, 438*b* that mate with end panel securing tabs (e.g., 444*a*, 444*b* in FIG. 4B or 445*a*, 445*b* in FIG. 4C) to enable secure stacking of containers assembled from the blank 400A and/or to permit air to flow through the container assembled from the blank 400A. Likewise, side panels 420*a*, 420*b* (as well as small parts of the adjacent bottom panel portions 402*a* and 402*b*) may have one or more optional cutouts 426*a*, 426*b*, 428*a*, 428*b* that mate with indexing tabs 425*a*, 425*b*, 427*a*, 427*b* to further enable secure stacking of containers assembled from the blank 200A and/or to permit air to flow through the container assembled from blank 400A.

Referring now to FIGS. 4B and 4C, therein are shown two configurations of end panel blanks 410, 450 that are separate from, and that may be used in conjunction with, blank 400A to form an assembled container. In some embodiments, two end panels 410, 450 are placed along opposed edges of the bottom panel portions 402*a* and 402*b* and are attached to end flaps 432*a*, 432*b*, 434*a* and 434*b*, to secure the end panels 410, 450 to the bottom panel portions 402*a*, 402*b* when the container is at least partially assembled from the blank 400A. The two pairs of side panel extensions 422*a*/424*a* and 422*b*/424*b* can then be attached to end panels 410, 450. Alternatively, the two pairs of side panel extensions 422*a*/424*a* and 422*b*/424*b* may be attached to end panels 410, 450 first, and then end flaps 432*a*, 432*b*, 434*a* and 434*b* may be attached to end panels 410, 450.

In some embodiments, two end panels 410 (FIG. 4B) may be placed along the opposed edges of the bottom panel portions 402*a* and 402*b* and attached to end flaps 432*a*, 432*b*, 434*a* and 434*b*. The two end panels 410 each have a slit/cutout 452 configured to capture the ends of the pleat to prevent the pleat from unfolding when the bottom pleat portion 414 is folded. Alternatively, two end panels 450 (FIG. 4C) may be placed along opposed edges of the bottom panel portions 402*a* and 402*b* and attached to end flaps 432*a*, 432*b*, 434*a* and 434*b*. The end panel 450 has a flat surface portion configured to cover an end of the pleat formed by the bottom pleat portion 414 when the pleat portion is folded into a pleat. In such embodiments, the ends of the pleat formed from bottom pleat portion 414 may be in proximity to and/or contact the flat surface portions of end panels 410. In some embodiments, the pleat formed from bottom pleat portion 414 may be glued or otherwise adhered to the flat surface portions of end panels 410.

Additionally, the two end panel blanks 410 of FIG. 4B may include cutouts 436*c*, 436*d*, which align with the cutouts 436*a*, 436*b* and 438*a*, 438*b* when a container is formed from the blank 400A of FIG. 4A and two end panels 410 of FIG. 4B. The cutouts provide openings in the container (e.g., for airflow; see also, 136, 138 of FIG. 1A). Likewise, the two end panels 450 of FIG. 4C may also include cutouts 438*c*, 438*d*, which align with the cutouts 436*a*, 436*b* and 438*a*, 438*b* when a container is formed from the blank 400A of FIG. 4A and two end panels 450 of FIG. 4C. End panels 410 and 450 may also include flap securing tabs 444*a*, 444*b* and 445*a*, 445*b*, respectively, which mate with cutouts 435*a*, 435*b*, 437*a* and 437*b* of FIG. 4A to secure lid flaps 430*a* and 430*b* to the container when the lid flaps are folded.

Figure 4D:
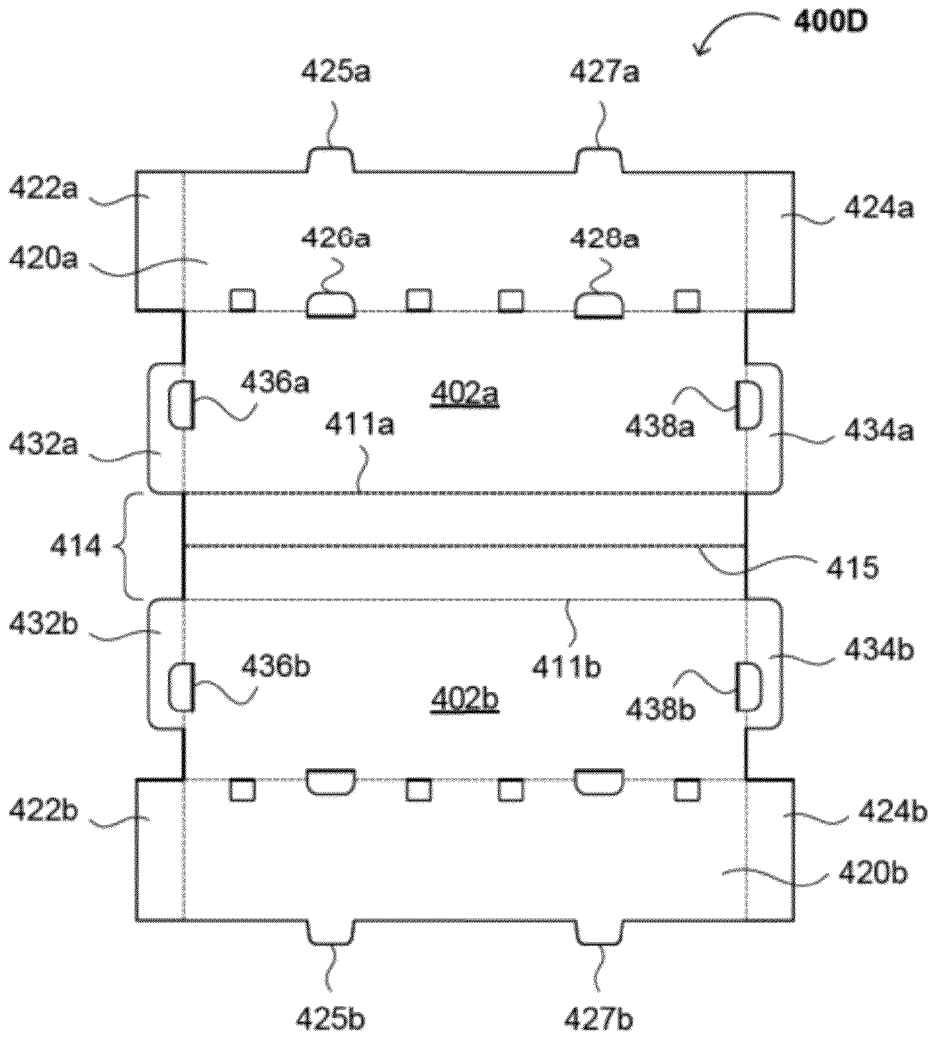
FIG. 4D shows an second exemplary blank for a tray-type container with a pleat in the bottom panel, where the end panels are separate from the container blank.

The bottom pleat portion 414 of FIGS. 4A and 4D is generally configured to fold upward along a center line and into the interior of the container, such that the underside of each half of each bottom pleat portion contacts the underside of the other half of the bottom pleat portion after folding. Multiple pleats may be formed in the bottom panel to provide further strength and/or reinforcement to the bottom panel, generally by including additional bottom pleat portions between the bottom panel portions 402*a*, 402*b*, and if the bottom panels are scored, alternating the surface of the bottom panel portion 402*a*, 402*b* of blank 400 on which adjacent scores are formed, and widening the slit 452 in the end panel 450 (see FIG. 2C). Alternative embodiments may include three or more bottom panel portions 414, wherein the bottom panel portions alternate with bottom pleat portions 414, such that after folding, the bottom pleat portions 414 form pleats that are spaced a distance apart across the width of container 400C (see, e.g., FIG. 1C). Generally, in such embodiments, the number of bottom panel portions will exceed the number of bottom pleat portions 414 by one (i.e., two bottom pleat portions 414 and three bottom panel portions, three bottom pleat portions 414 and four bottom panel portions, etc.). The width of the bottom panel portions may be equal, and therefore, the pleats may be spaced equally apart after folding. Alternatively, the widths of the bottom panel portions may be different, and the pleats may be spaced apart unequally after folding.

Generally, slit 452 in FIG. 4C has dimensions accommodating a pleat formed from the bottom pleat portions 414. The dimensions of the slit 452 may be slightly greater than the end dimensions of the pleat, but generally not more than 25% greater. For example, if the end of the pleat (seen in FIG. 1A through the slit 152) has surface dimensions of 5 cm×1 cm, the slit 452 may have dimensions of 5.5 cm×1.2 cm. In some embodiments, slit 452 is configured to capture the ends of a multi-pleat when two or more bottom pleat portions 414 are folded into the multi-pleat (see, e.g., FIG. 1D). In yet other embodiments, there may be more than one slit 452 in each end panel 450, and each slit may be configured to capture the ends of one or more pleats formed from one or more pleat portions 414. End panels 450 may also include cutouts for handles (not shown).

Figure 4E:
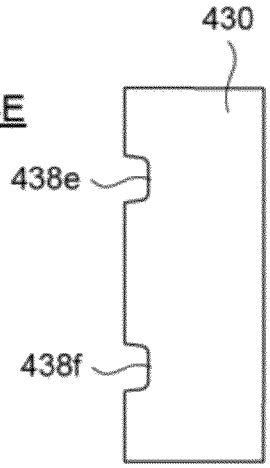
FIG. 4E shows a separate end panel blank with a flat surface portion that covers one end of the pleat formed from the container blank of FIG. 2D.

FIG. 4D shows a blank 400D similar to the blank 400A of FIG. 4A, except that the blank 400D, when assembled, forms a tray-type container without any lid flaps (such as the lid flaps 430*a*, 430*b* of FIG. 4A). FIG. 4E shows an end panel 430, two of which may be used in conjunction with blank 400D to form a tray type container. Although end panel 430 is shown without slits (similar to end panel 210 in FIG. 4C), an end panel with slits to capture the pleat formed from pleat portion 414 (similar to end panel 410 in FIG. 4B) may also be used in conjunction with blank 400D for form a tray-type container. Similar to cutouts 436*c*/436*d* and 438*c*, 438*d* in end panel 450 of FIG. 4B and end panel 410 of FIG. 4C, respectively, in some embodiments, end panel 430 of FIG. 4E may have cutouts 438*e*, 438*f*, which align with cutouts 436*a*/436*b* and 438*a*/438*b* of FIG. 4D when a container is formed from blank 400D of FIG. 4D and two end panels 430 of FIG. 4E.

Figure 5A:
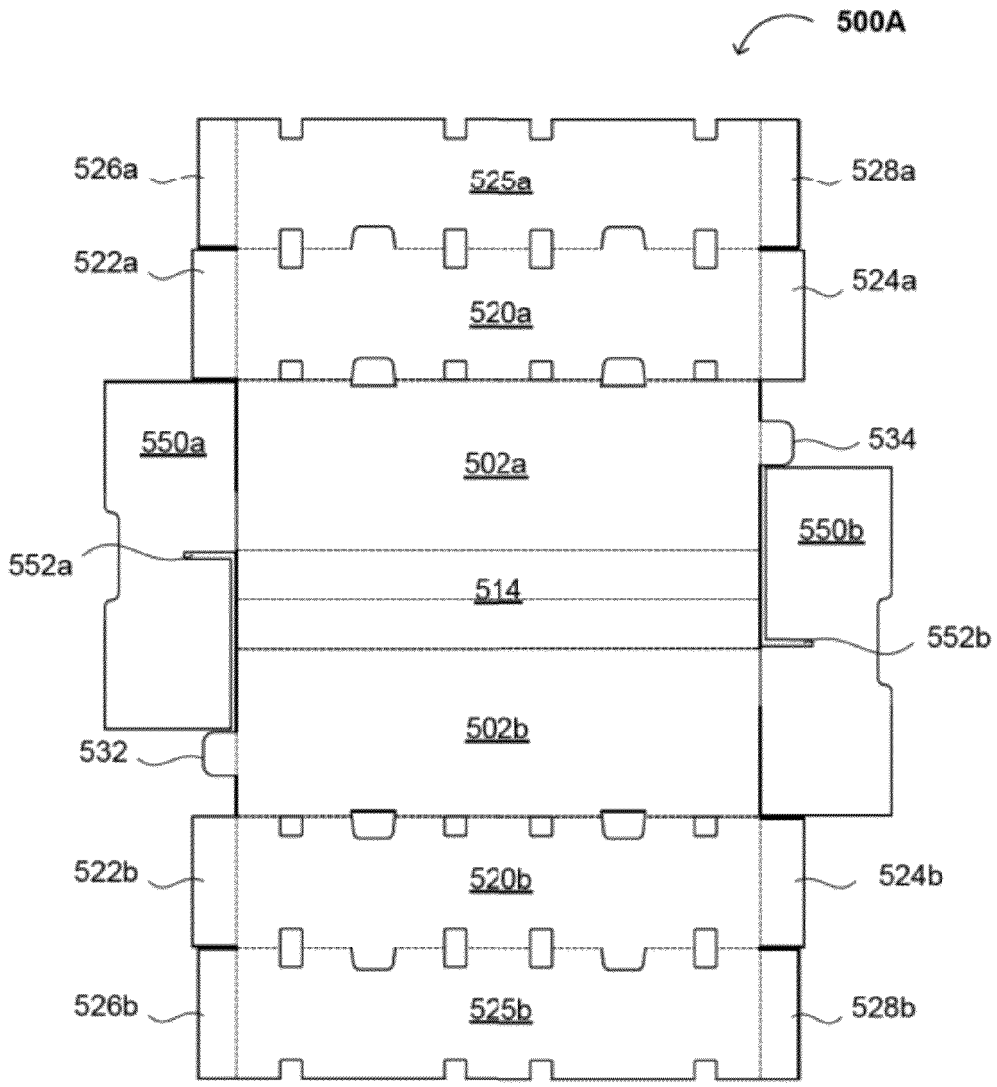
FIG. 5A shows a third exemplary blank for a tray-type container with a pleat in the bottom panel, end panels with slits to capture the pleat foldably attached to the container, and end flaps for securing part of the end panel to an unattached bottom panel.

FIG. 5A shows a blank 500A for a tray-type box having a pleat 514 foldably attached to bottom panel portions 502*a*, 502*b* and "integrated" or foldably-attached end panels 550*a*, 550*b*. A portion of the end panel 550*a* is foldably attached to bottom panel portion 502*a*, and a portion of end panel 550*b* is foldably attached to bottom panel portion 502*b* of blank 500A. Bottom pleat portion 514 is folded along a center line to form a pleat, similar to bottom pleat portion 414 of FIG. 4A. However, end panels 550*a*, 550*b* are folded at an angle of from about 90° to about 100° (e.g., 90°, 91°, 92°, 95°, etc.) towards the pleat, thereby inserting the pleat into slits 552*a*, 552*b*.

Blank 500A also includes side panels 520*a*, 520*b*, and optional inner sidewalls 525*a*, 525*b*, which may reinforce and/or strengthen the container formed from blank 500A. Each of the side panels 520*a*, 520*b* has a pair of side panel extensions 522*a*/524*a* and 522*b*/524*b*, respectively, which may be secured to the outside of the end panels 550*a*, 550*b*. Blank 500A also includes optional end flaps 532, 534, which may further secure the portions of the end panels 550*a*, 550*b* that are not attached to bottom panels 502*a*, 502*b*, to the container formed from blank 500A. In addition, in the embodiment show in FIG. 5A, inner sidewall extensions 526*a*/528*a* and 526*b*/528*b* extend from inner sidewalls 525*a*, 525*b* and may be secured to the inside of the end panels 550*a*, 550*b*, and can add further support and/or stacking strength to the end panels 550*a*, 550*b*, particularly the portions of the end panels 550*a*, 550*b* that are cut away from the bottom panel portions 502*a*, 502*b*. Additionally, optional end flaps 532, 534 may be secured to end panels 550*a*, 550*b* and may further support and add strength to the end panels 550*a*, 550*b* when the container is formed form the blank 500A. In embodiments with end flaps 532 and 534, the end flaps 532 and 534 should be located in the blank 500A at a distance away from side panel extensions 524*a* and 522*b* so as not to interfere and/or overlap with side panel extensions 524*a* and 522*b* when the container is formed from container blank 500A (i.e., when both end flaps 532, 534 and side panel extensions 524*a*, 522*b* are folded against and/or adhered or affixed to end panels 550*a*, 550*b*).

In one embodiment (not shown), inner sidewall extensions 526*a*, 526*b*, 528*a* and 528*b* include two foldable extension portions, the first portion (attached to the inner sidewall 525*a* or 525*b*) being configured to fold to an angle of about 100-170° with respect to the inner sidewall 525*a* or 525*b* and forming a triangular feature or gusset in the corner of the box, and the second portion (attached to the first portion) being configured to fold to an angle of about 90° with respect to the inner sidewall 525*a* or 525*b* and being configured to be secured to the end panel 550*a* or 550*b*. For examples of such triangular features or gussets, see U.S. patent application Ser. No. 12/183,016, the relevant portions of which are incorporated herein by reference.

Figure 5B:
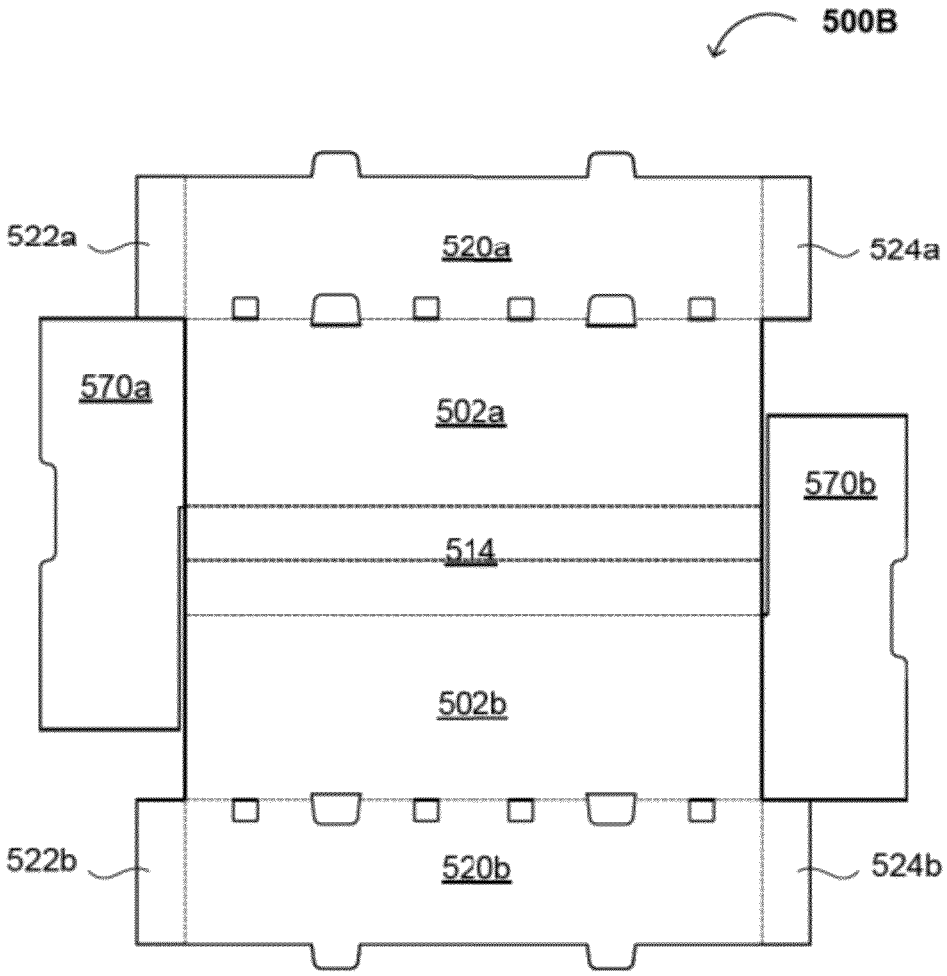
FIG. 5B shows a fourth exemplary blank for a tray-type container with a pleat in the bottom panel and end panels with flat surface portions that cover the ends of the pleat.

FIG. 5B shows a container blank 500B similar to blank 500A of FIG. 5A, except that blank 500B has no inner sidewall panels (such as the inner sidewall panels 525*a*, 525*b* of FIG. 5A), end panels 570*a*, 570*b* (which are foldably attached to bottom portions 502*a*, 502*b*) do not have slits, and the bottom panels 502*a*, 502*b* do not have foldable attached end flaps. When a container is formed from blank 500B, the end panels 550*a*, 550*b* will be adjacent to and/or contact the pleat formed by bottom pleat portion 514. In some embodiments, the end panels 570*a*, 570*b* of FIG. 5B may have slits, and in other embodiments, the end panels 550*a*, 550*b* of FIG. 5A may have only flat surface portions without slits.

Exemplary Methods of Making Containers with Reinforced Bottom Panels

Figure 6:
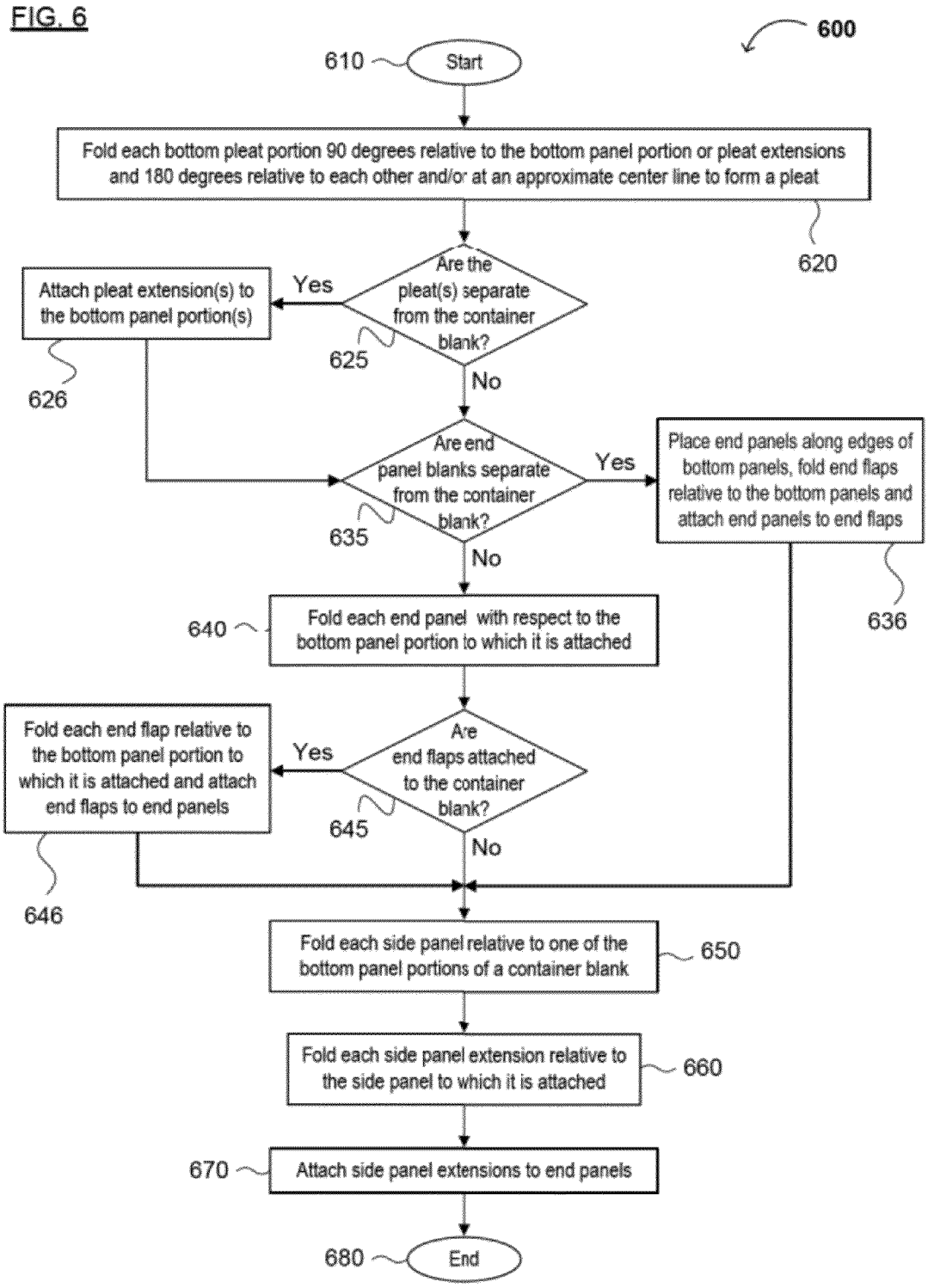
FIG. 6 is a flow diagram showing exemplary methods of making the present containers from a container blank and optionally, from end panel blanks and/or one or more pleat blanks.

FIG. 6 shows a flow diagram 600 for an exemplary method of forming containers with reinforced bottom panels. The method begins at 610. At 620, each bottom pleat portion (e.g., 414 in FIGS. 4A and 4D, or 514 in FIGS. 5A and 5B) is folded to form a pleat. In embodiments where the pleat is formed from a pleat blank separate from the container blank (e.g., pleat blanks 300A and 300B in FIGS. 3A and 3B, respectively), the bottom pleat portion (e.g., 340 in FIG. 3A or 341 in FIG. 3B) is folded at an angle of about 90° with respect to the pleat extension(s) to which it is attached (e.g., 342*a-b* in FIG. 3A or 382*a-b*, 383*a-b* and 384*a-b* in FIG. 300B) and at an angle of about 180° at an approximate center line to form a pleat (e.g., pleat 240 in FIG. 2). In alternative embodiments where the bottom pleat portion is integral with the blank (e.g., 514 in FIGS. 5A and 5B), the bottom pleat portion is folded at an angle of about 90° with respect to the bottom panel portions to which it is attached (e.g., 502*a* and 502*b* in FIGS. 5A and 5B) and at an angle of about 180° at an approximate center line in the bottom pleat portion to form a pleat (such as pleats 140, 140*a-e* in FIGS. 1A-1D). In embodiments having two or more back-to-back pleats (e.g., 140*c*, 140*d* in FIG. 1D), each bottom pleat portion is folded at an angle of about 90° with respect to the bottom panel portion to which it is attached (if any), and at an angle of about 180° in one direction at an approximate center line in each bottom pleat portion, and at an angle of about 180° in the opposite direction at an edge or border between adjacent bottom pleat portions. To facilitate folding, the approximate center line and/or the opposing edges of each bottom pleat portion may be scored. In some embodiments, the approximate center line(s) and opposed edges may be scored on the same side of the blank. In alternative embodiments, the approximate center line(s) and opposed edges may be scored on opposite sides of the blank.

Generally, a pleat may be formed by pushing in one direction on a center line of the bottom pleat portion and/or pushing opposed edges of each bottom panel portion in a second direction. Specifically, in some embodiments, each pleat will be formed by (i) pushing vertically upward on the center line of the bottom pleat portion and/or (ii) pushing the edges of each bottom pleat portion toward each other. However, in other embodiments, the pleat may be formed by pushing down on the center line of the bottom pleat portion (e.g., if the container is formed upside down or the underneath side of the bottom panel is facing up when the pleat is formed) or in some other direction. In embodiments comprising multiple pleats integral with the container blank, where the bottom pleat portions are spaced apart some distance, the steps of pushing in one direction on an approximate center line of the bottom pleat portion and/or pushing opposed edges of each bottom panel portion in a second direction may be performed simultaneously or repeated using appropriate folding bars, blades and/or mandrels for each bottom pleat portion. In embodiments comprising multiple pleats back-to-back, the pleats may be formed by pushing in one direction on an approximate center line of each bottom pleat portion, pushing in the opposite direction on an edge or border between the bottom pleat portion and another bottom pleat portion and/or pushing opposed edges of each bottom panel portion in a third direction. The steps of pushing in one direction on an approximate center line of each bottom pleat portion and pushing in the opposite direction on an edge or border between the bottom pleat portion and another bottom pleat portion may be performed using one or more blades and/or bars mounted on one or more slidable support frames or racks, and pushing opposed edges of each bottom panel portion in a third direction may be performed using one or more appropriately configured movable bars or mandrels. One or more of the steps of pushing in one direction on an approximate center line of each bottom pleat portion, pushing in the opposite direction on an edge or border between the bottom pleat portion and another bottom pleat portion and/or pushing opposed edges of each bottom panel portion in a third direction may be performed simultaneously or sequentially.

In some embodiments, the method may also include applying glue and/or another adhesive to the back side of the bottom pleat portions prior to folding and/or attaching the formed pleat to the bottom panel(s). In other embodiments, the method may further include inserting a secondary stiffener into the folds in the pleat after the pleat is folded, but before the pleat is captured by the slits in the end panels and/or before the pleat is attached to the bottom panel(s). In some embodiments, the method may include applying glue and/or other adhesive to the stiffener and/or to the back side of the pleat to hold the stiffener against the bottom pleat portion during the folding process. In yet other embodiments, the method may include applying glue and/or other adhesive to hold back-to-back pleats against each other.

At 625, one of two alternative steps is taken, depending on whether the pleats were formed from pleat blanks separate from the container blank (e.g., pleat 240 in FIG. 2) or from pleat portions foldably attached to the container blank (such as bottom pleat portions 414 in FIGS. 4A and 4D, or bottom pleat portions 514 in FIGS. 5A and 5B). If the pleats were formed from separate pleat blanks, each pleat formed will have at least one pleat extension (such as pleat extension 242 in FIG. 2), and at 626, the pleat extension(s) are attached to at least one bottom panel (such as bottom panel 202 in FIG. 2).

At 635, one of two alternative steps is taken depending on whether the end panels are (i) blanks that are separate from the container blank (e.g., 410 in FIG. 4B, 450 in FIG. 4C or 430 in FIG. 4E) or (ii) foldably attached to the container blank (e.g., 550*a*, 550*b* in FIG. 5A or 570*a*, 570*b* in FIG. 5B). If the end panel blanks are separate, at 636, each end panel is placed along edges of the bottom panels, and end flaps (e.g., 432*a*, 432*b*, 434*a* and 434*b*) are folded at from about 85° to 100° with respect to the bottom panel to which each end flap is attached. If the end panels are foldably attached to the container blank, at 640 the end panels (e.g., 550*a*, 550*b* in FIG. 5A or 570*a* or 570*b* in FIG. 5B) are folded at about 85-100° with respect to the bottom panel to which the end panel is foldably attached (e.g., bottom panels 502*a* or 502*b* in FIGS. 5A and 5B). In embodiments in which the end panels have a slit or cutout (e.g., 410 in FIG. 4B or 550*a*, 550*b* in FIG. 5A), the end panels are typically folded at an angle of from about 90° to about 100° (i.e., 90°, 91°, 92°, 95°, 98°, etc.) in order to capture the ends of the pleat. In embodiments in which the end panels have a flat surface portion (e.g., 450 in FIG. 4C, 430 in FIG. 4E or 570*a*, 570*b* in FIG. 5B) the end panels are typically folded at an angle of from about 85° to 90° (i.e., 85°, 86°, 88°, 90°, etc.), in order to contact and/or be in close proximity to the pleat(s). In embodiments that include end flaps, the end flaps are typically folded at approximately the same angle as the end panel to which the end flap attaches.

At 645, one of two steps is taken, depending on whether there are end flaps attached to the container blank that were not already folded at 636 (e.g., 532, 534 in FIG. 5A). If there are end panels that have not already been folded, at 646, the end flaps are folded at from about 85° to 100° with respect to the bottom panel portions to which the end flaps are attached (e.g., 502*a*, 502*b* in FIGS. 5A and 5B). At 650, each of two side panels (e.g., 420*a*, 420*b* in FIGS. 4A and 4D, or 520*a*, 520*b* in FIGS. 5A and 5B) is folded at an angle of from about 85° to 100° relative to one of the bottom panel portions (e.g., 402*a* or 402*b* in FIGS. 4A and 4D, or 502*a*, 502*b* in FIGS. 5A and 5B) of a container blank (such as blank 400A in FIG. 4A, or blank 500A in FIG. 5A). At 660, each side panel extension of two pairs of side panel extensions (such as side panel extensions 422*a*/424*a* and 422*a*/424*b* in FIGS. 4A and 4D, or 522*a*/524*a* and 522*b*/524*b* in FIGS. 5A and 5B) is folded at an angle of about 90° with respect to the side panel to which the side panel extension is attached. At 670, the side panel extensions are attached to the end panels, and at 680, the exemplary process of forming containers with reinforced bottom panels is complete.

In embodiments in which the end panel blanks are separate from the container blank, (i) placing the end panels along the edges of the bottom panels, folding the end flaps relative to the bottom panels and attaching the end panels to the end flaps, (ii) folding each side panel relative to a corresponding one of the bottom panel portions of the container blank, (iii) folding each side panel extension relative to the side panel to which it is attached, and (iv) attaching the side panel extensions to the end panels may be performed roughly simultaneously, or alternatively, may be performed sequentially. Further, in some embodiments, (i) placing the end panels along the edges of the bottom panels, folding the end flaps relative to the bottom panels and attaching the end panels to the end flaps, (ii) folding each side panel relative to a corresponding one of the bottom panel portions of the container blank, and (iii) folding each side panel extension relative to the side panel to which it is attached, may be performed in any plausible sequence or order. Similarly, in alternative embodiments in which the end panels are part of the container blank, (i) folding each end panel with respect to the bottom panel portion to which it is attached, (ii) folding each side panel relative to a corresponding one of the bottom panel portions of the container blank, (iii) folding each side panel extension relative to the side panel to which it is attached, and (iv) attaching the side panel extensions to the end panels, may be performed roughly simultaneously or sequentially, and if performed sequentially, may be performed in any plausible sequence or order.

Additionally, in some embodiments, the container with the reinforced bottom panel may be assembled using apparatuses and/or equipment that automatically form the pleat(s) and/or the container from the container blank, pleat blank(s) and/or end panel blanks (see, e.g., U.S. Prov. Pat. Appl. No. 61/510,030). In such embodiments, the pleat(s) may be formed as described above using one or more bars (including folding bars), blades and/or mandrels mounted on one or more slidable support frames or racks, which are automatically driven and/or actuated. In some embodiments, the formed pleat(s) and/or the container blank may be transferred to another forming station using one or more feed wheel(s), clutch mechanism(s) and/or other automatic transfer mechanism(s). The formed pleat(s) and/or the container blank may also be automatically positioned relative to a mandrel and/or compression mechanism using a centering mechanism, centering blocks and/or other automatic positioning mechanism. In embodiments in which the end panels blanks are separate from the container blank, the end panels may also be automatically positioned relative to the mandrel, the compression mechanism, the container blank and/or the pleat(s) using plates, bars, fingers and/or picks which may be mechanically and/or electrically driven and/or spring-loaded to hold and release the end panels over or near the ends of the pleat(s). In some embodiments, the mandrel and/or compression mechanism may automatically force and/or wrap the container blank, thereby forming the container.

In some embodiments, the method of making containers with reinforced bottom panels further includes inserting the pleat (e.g., the pleat formed by 414 in FIG. 4A or 514 in FIG. 5A) into the slits or cutouts in each of two the end panels (e.g., into slit or cutout 452 in end panel 410 in FIG. 4B or 552*a*, 552*b* in end panels 550*a*, 550*b* in FIG. 5A). In some embodiments, the method also includes folding lid flaps (e.g., 430*a*, 430*b* in FIG. 4A) at an angle of about 90° relative to the side panels (e.g., 420*a*, 420*b* in FIG. 4A) and/or securing the lid flaps at the angle of about 90° by catching the lid flap openings (e.g., 435*a*, 435*b*, 437*a*, 437*b* in FIG. 4A) on the flap securing taps (e.g., 444*a*, 444*b* in FIG. 4B or 445*a*, 445*b* in FIG. 4C) on the top of each end panel (e.g., end panel 410 in FIG. 4B or 450 in FIG. 4C). Alternatively, the lid flaps may remain unfolded, and the method may further comprise stacking two or more containers using the apparatuses and/or methods set forth in U.S. patent application Ser. No. 13/218,244, the relevant portions of which are incorporated herein by reference.

The method of making the present container may further comprise applying glue and/or other adhesive to a back side of at least one of the pleat portions (e.g., 414 in FIG. 4A or 4B, or 514 in FIG. 5A or 5B) prior to folding the pleat portions and/or inserting the pleat(s) into the slits (e.g., 452 in FIG. 4C or 552*a*, 552*b* in FIG. 5A) in the end panels. Typically, glue or another adhesive is applied to at least one of each side panel extension (e.g., 422*a*, 424*a*, 422*b*, and 424*b* in FIGS. 4A and 4B, or 522*a*, 522*b*, 524*a*, 524*b* in FIGS. 5A and 5B) and/or a corresponding location on the end panels (e.g., 410 in FIG. 2B, 450 in FIG. 2C, 430 in FIG. 2E, 550*a*, 550*b* in FIG. 5A or 570*a*, 570*b* in FIG. 5B) to secure the side panel extensions to the end panels. Similarly, in some embodiments, glue and/or other adhesive may be applied to each end flap (e.g., 432*a*, 432*b*, 434*a* and 434*b* in FIGS. 4A and 4D, or 532, 534 in FIG. 5A) and/or a corresponding location on the end panels to secure the end panels to the end flaps. Following each application of glue and/or other adhesive, pressure may also be applied to the container components being glued or adhered to each other to facilitate the adhesion process.

Exemplary Methods of Using Containers with Reinforced Bottom Panels

The present container is generally used by placing a plurality of items in the container (e.g., packing the container), and storing the container for at least a minimum period of time. In various embodiments, the items may comprise food products, articles of fresh produce, plant products, or any other product or article having some moisture (e.g., water) or other liquid content.

In some embodiments, the container may be stored in an environment having a relatively high humidity level (e.g., at least 50%, 60%, 70%, 80%, or any other value of at least 50%), such as a refrigerated container (e.g., a refrigerator, freezer or other cold box), vehicle (e.g., a refrigerated truck), or room (e.g., a refrigerated storage room or walk-in freezer), or in an outdoor environment having prolonged periods of relatively high humidity (e.g., during the summer in the eastern or southeastern United States, in a subtropical or tropical outdoor environment or ambient storage location, etc). The minimum period of time may be at least one hour, six hours, one day, or longer.

In various embodiments, the method of using the containers may further include stacking the containers. The stack of containers may be as high as 3, 4, 5, 6, or more containers, depending on the design of the container, the articles or items stored therein, and the environment in which the packed container is stored.

CONCLUSION/SUMMARY

Thus, the present invention advantageously provides containers with reinforced bottom panels having pleats that provide extra strength to the bottom panels of the containers, thereby reducing or eliminating bottom sag. The present containers are particularly useful for storing and/or shipping high water-content goods and/or for use in high humidity environments. The present invention also provides container blanks for efficiently forming containers with reinforced bottom panels, and methods of making and using such containers.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A container blank comprising:

a) at least two bottom panel portions, each bottom panel portion having a pair of first opposed edges;

b) one or more bottom pleat portions, each bottom pleat portion foldably attached to (i) one or more of the at least two bottom panel portions at a first edge of the pair of first opposed edges, or (ii) another bottom pleat portion, wherein each of the one or more bottom pleat portions is configured to form a pleat when folded about 180° at a center line;

c) two side panels, each of the side panels foldably attached to one of the at least two bottom panel portions at a second edge of the pair of first opposed edges;

d) two end panels, each end panel having one or more slits configured to capture one or more of the one or more bottom pleat portions when the one or more bottom pleat portions are folded along corresponding center lines to form one or more pleats, wherein the one or more slits are at an interface between the bottom panel portions and the end panel, and the one or more pleats have a height that is about 10% to about 90% of a height of the end panels; and e) two pairs of side panel extensions, each pair of side panel extensions foldably attached to one of the two side panels at a pair of opposed side edges, wherein each of the side panel extensions is configured to attach to one of the two end panels when the container is formed from the container blank.

2. The container blank of claim 1, wherein the first edge(s) of the pair(s) of first opposed edges and the center line(s) are scored on a first surface of the container blank.

3. The container blank of claim 1, wherein the first edge(s) of the pair(s) of first opposed edges are scored on a first surface of the container blank, and the center line(s) are scored on a second surface of the container blank opposite to the first surface.

4. The container blank of claim 1, wherein each end panel is separate from the bottom panel portions and the bottom pleat portions.

5. The container blank of claim 1, further comprising two or more end flaps, each end flap foldably attached to one of the at least two bottom panels at one edge of a second pair of opposed edges, wherein each end flap is configured to attach to one of the two end panels when the container is assembled from the container blank.

6. The container blank of claim 5, comprising two or more of said end flaps foldably attached to each of the at least two bottom panels.

7. The container blank of claim 1, wherein at least a portion of each end panel is foldably attached to one of the bottom panel portions at one edge of a second pair of opposed bottom edges.

8. A container comprising:

a) one or more bottom panels;

b) one or more pleats, each pleat attached to at least one of the one or more bottom panels at an angle of about 90° relative to the bottom panel(s), each of the one or more pleats being folded at a center line at an angle of about 180°;

c) two side panels, each of the side panels foldably attached to one of the one or more bottom panels at an angle of from about 85° to about 100° relative to the one or more bottom panels;

d) two end panels, each end panel having one or more slits configured to capture one or more of the one or more pleats, wherein the one or more slits are at an interface between the bottom panels and the end panel, and the one or more pleats have a height that is about 10% to about 90% of a height of the end panels and/or a height of the side panels; and e) two pairs of side panel extensions, each pair of the side panel extensions foldably attached to one of the two side panels and attached to the two end panels.

9. The container of claim 8, wherein each of the one or more pleats comprises one or more pairs of pleat portions, each pleat portion being foldably attached to the other pleat portion of the pair and to the one or more bottom panels or another pleat portion.

10. The container of claim 8, wherein each of the one or more pleats comprises at least one pleat extension, each pleat extension affixed to one of the one or more bottom panels.

11. The container of claim 8, further comprising two or more end flaps, each end flap foldably attached at an angle of from about 85° to about 100° to one of the two bottom panels at one edge of a second pair of opposed edges, and affixed to one of the two end panels.

12. The container of claim 8, wherein each end panel is formed from a blank separate from a container blank for the bottom panel(s) and side panel(s).

13. The container of claim 12, comprising two or more of said end flaps foldably attached to each of the at least two bottom panels.

14. A method of protecting or handling items, comprising a) placing a plurality of items in the container of claim 8; and b) storing the container for at least a minimum period of time.

15. The method of claim 14, wherein the plurality of items comprise products or articles having water and/or other liquid content therein, or the container is stored in an environment having a humidity level of from 50% to 100%.

16. A method of forming a container, comprising:

a) folding each of two side panels to form an angle of from about 85° to about 100° with respect to one of at least two bottom panel portions of blank for a container;

b) folding each of one or more bottom pleat portions about 180° at a center line to form a pleat by pushing in a first direction on each of the one or more bottom pleat portions and/or pushing opposed edges of each bottom pleat portion in a second direction;

c) folding each side panel extension of two pairs of side panel extensions at about 90° with respect to the side panel to which the side panel extension is attached;

d) capturing ends of each of the one or more pleats in a slit in each end panel, wherein the slit is are at an interface between one of the bottom panels and the end panel, and the one or more pleats have a height that is about 10% to about 90% of a height of the end panels; and attaching each of the side panel extensions to one of two end panels.

17. The method of claim 16, further comprising placing separate end panels along edges of bottom panel(s), and folding each of at least two end flaps at an angle of from about 85° to about 100° with respect to one of at least two bottom panels to which the end flaps are foldably attached.

18. The method of claim 16, further comprising applying an adhesive to an underside of at least one bottom pleat portion prior to folding the bottom pleat portion to form a pleat.

19. The method of claim 16, wherein each bottom pleat portion is formed from a pleat blank separate from a container blank, and each bottom pleat portion has one or more pleat extensions configured to attach to at least one of the at least two bottom panel portions.

20. The method of claim 16, wherein at least a portion of each of the two end panels are foldably attached to one of at least two bottom panel portions, and the method further comprises folding each of the two end panels at an angle of from about 85° to from 100° with respect to the bottom panel to which the end panel is attached, and applying an adhesive to one or more of the sidewall panel extensions and/or corresponding location(s) on the end panel(s) prior to attaching the sidewall panel extensions to the end panel(s).

* * * * *